US008167639B2

(12) United States Patent
Weidner

(10) Patent No.: US 8,167,639 B2
(45) Date of Patent: May 1, 2012

(54) COAXIAL LATCHING CONNECTOR ASSEMBLY

(75) Inventor: Kevin E. Weidner, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 33 days.

(21) Appl. No.: 12/698,278

(22) Filed: Feb. 2, 2010

(65) Prior Publication Data

US 2011/0189874 A1 Aug. 4, 2011

(51) Int. Cl.
*H01R 13/627* (2006.01)

(52) U.S. Cl. ..... 439/352

(58) Field of Classification Search ..... 439/352, 439/350, 372, 271, 278, 292, 293
See application file for complete search history.

(56) References Cited

U.S. PATENT DOCUMENTS 4,059,296 A * 11/1977 Panourgias ..... 285/312
4,537,454 A 8/1985 Douty et al.
5,017,149 A 5/1991 Hatanaka
5,151,049 A 9/1992 Mosquera
5,219,459 A 6/1993 Kaneko
5,595,499 A 1/1997 Zander et al.
6,543,812 B1 * 4/2003 Chang ..... 285/81
6,791,031 B1 * 9/2004 Manning ..... 174/659
6,846,189 B2 * 1/2005 Murayama et al. ..... 439/108
2009/0004906 A1 * 1/2009 Koch et al. ..... 439/352

* cited by examiner

*Primary Examiner* — Tulsidas C Patel
*Assistant Examiner* — Phuongchi Nguyen

(57) ABSTRACT

A connector assembly includes a receptacle connector that has a housing, a lever arm, and a center contact. The housing defines an interior chamber. The lever arm is pivotally joined to the housing. The center contact is disposed within the interior chamber and is oriented along a longitudinal axis of the receptacle connector. The mating connector includes a plug body and an axial conductive member. The axial conductive member is disposed in the plug body along a center axis of the plug body. The lever arm of the receptacle connector engages the plug body of the mating connector when the plug body is received in the interior chamber and pivots relative to the housing to drive the plug body within the interior chamber and mate the axial conductive member with the center contact.

22 Claims, 7 Drawing Sheets

COAXIAL LATCHING CONNECTOR ASSEMBLY

BACKGROUND OF THE INVENTION

The subject matter herein relates generally to connector assemblies, and more particularly, to latching connector assemblies.

Known connector assemblies include two connectors that mate with one another to communicate data and/or power signals between the connectors. In order to ensure that the connectors remain mated to one another, one of the connectors may include spring beams that are biased by the other connector when the connectors mate with each other. The spring beams are biased to a position that secures the connectors together. For example, the spring beams may be outwardly biased when the spring beams engage features on the other connector. The outward biasing of the spring beams increases the amount of force that is required to separate the connectors. As a result, the connectors may remain coupled in the absence of a sufficiently strong separation force that overcomes the spring beams.

One problem with the spring beams is that the beams may become fatigued over time. Repeated coupling and decoupling of the connectors requires repeated biasing of the spring beams. As the spring beams are repeatedly biased, the spring beams can weaken. The weakened spring beams may be unable to prevent the connectors from being inadvertently separated. For example, the amount of force required to separate the connectors may be decreased when the spring beams are weakened.

Coaxial connectors may include spring beams to secure the coaxial connectors in a mated relationship. When the coaxial connectors are mated, the center signal contact of each coaxial connector mates with the center signal contact of the other coaxial connector and the shields of the coaxial connectors mate with one another. As the spring beams weaken, the coaxial connectors may be unable to remain in a mated relationship and the shields and/or center signal contacts may separate from one another.

Thus, a need exists for an assembly that retains two connectors in a mated relationship and that can retain the connectors in a mated relationship after repeated coupling and decoupling of the connectors. Additionally, a need exists for an assembly that secures two coaxial connectors in a mated relationship after repeated coupling and decoupling of the coaxial connectors.

BRIEF DESCRIPTION OF THE INVENTION

In one embodiment, a connector assembly is provided. The connector assembly includes a receptacle connector that has a housing, a lever arm, and a center contact. The housing defines an interior chamber. The lever arm is pivotally joined to the housing. The center contact is disposed within the interior chamber and is oriented along a longitudinal axis of the receptacle connector. The mating connector includes a plug body and an axial conductive member. The axial conductive member is disposed in the plug body along a center axis of the plug body. The lever arm of the receptacle connector engages the plug body of the mating connector when the plug body is received in the interior chamber and pivots relative to the housing to drive the plug body within the interior chamber and mate the axial conductive member with the center contact.

In another embodiment, a coaxial receptacle connector is provided. The receptacle connector includes a housing, a center contact, and a lever arm. The housing defines an interior chamber that extends along a longitudinal axis. The center contact is disposed in the interior chamber and is oriented along the longitudinal axis. The lever arm is pivotally joined to the housing and extends between an engagement end disposed within the housing and an actuation end disposed outside the housing. The engagement end contacts a mating connector that is loaded into the interior chamber and the actuation end is moveable to pivot the lever arm. The lever arm pivots to move the engagement end and drive the mating connector toward the center contact along the longitudinal axis.

In another embodiment, a receptacle connector is provided. The receptacle connector includes a housing, a center contact, an outer contact, and a lever arm. The housing defines an interior chamber extending along a longitudinal axis. The interior chamber receives a mating connector that includes an axial conductive member and a conductive ring extending around the axial conductive member. The center contact is disposed within the interior chamber. The outer contact extends around the center contact within the interior chamber. The lever arm is pivotally joined to the housing to engage and drive the mating connector along the longitudinal axis in the interior chamber when the mating connector is loaded into the interior chamber. The lever arm drives the mating connector toward the outer contact until the outer contact is electrically coupled with the conductive ring of the mating connector and the center contact is electrically joined with the axial conductive member of the mating connector.

DETAILED DESCRIPTION OF THE INVENTION

Figure 1:
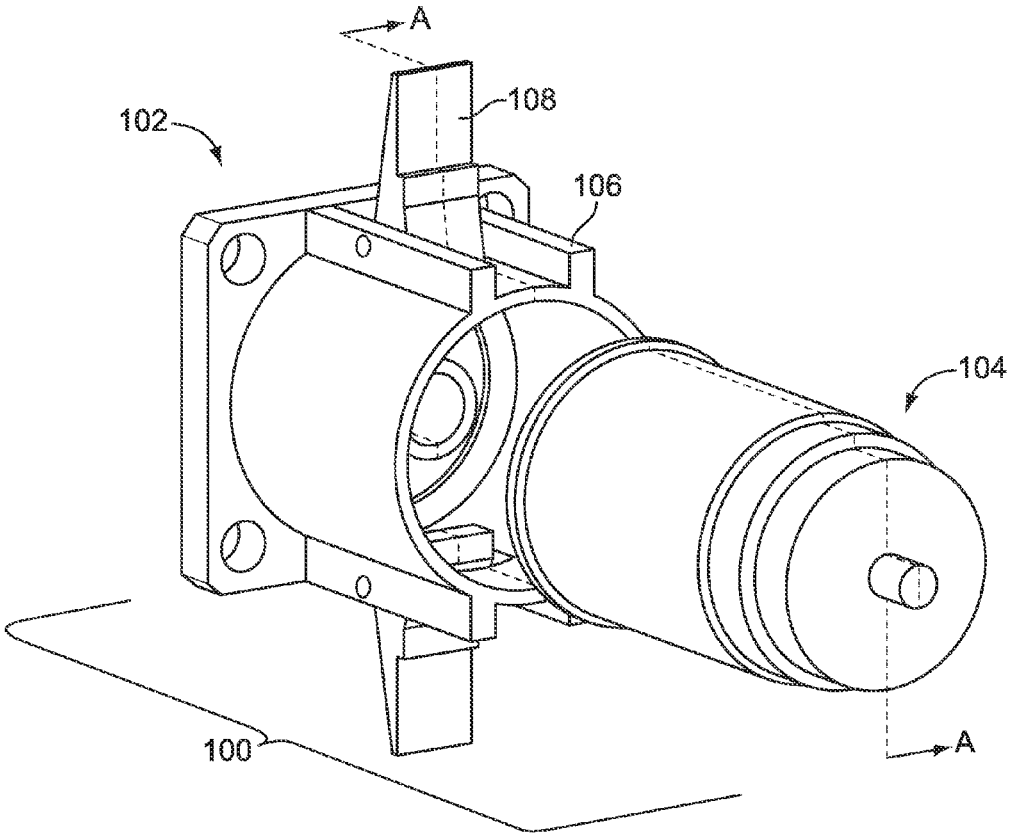
FIG. 1 is a perspective view of a latching connector assembly in an unmated relationship in accordance with one embodiment of the present disclosure.

FIG. 1 is a perspective view of a latching connector assembly 100 in an unmated relationship in accordance with one embodiment of the present disclosure. The illustrated connector assembly 100 includes coaxial connectors, but alternatively may include connectors other than coaxial connectors. A receptacle connector 102 receives a mating connector 104 to electrically communicate data and/or power signals therebetween. The receptacle connector 102 includes lever arms 108 that are pivotally joined to a housing 106 of the receptacle connector 102. As described below, the lever arms 108 pivot with respect to the housing 106 to grasp and drive the mating connector 104 into an abutted relationship with the receptacle connector 102. The lever arms 108 may lock into position to secure the mating connector 104 in the abutted relationship with the receptacle connector 106 and ensure that the receptacle and mating connectors 102, 104 remain mated with each other.

Figure 2:
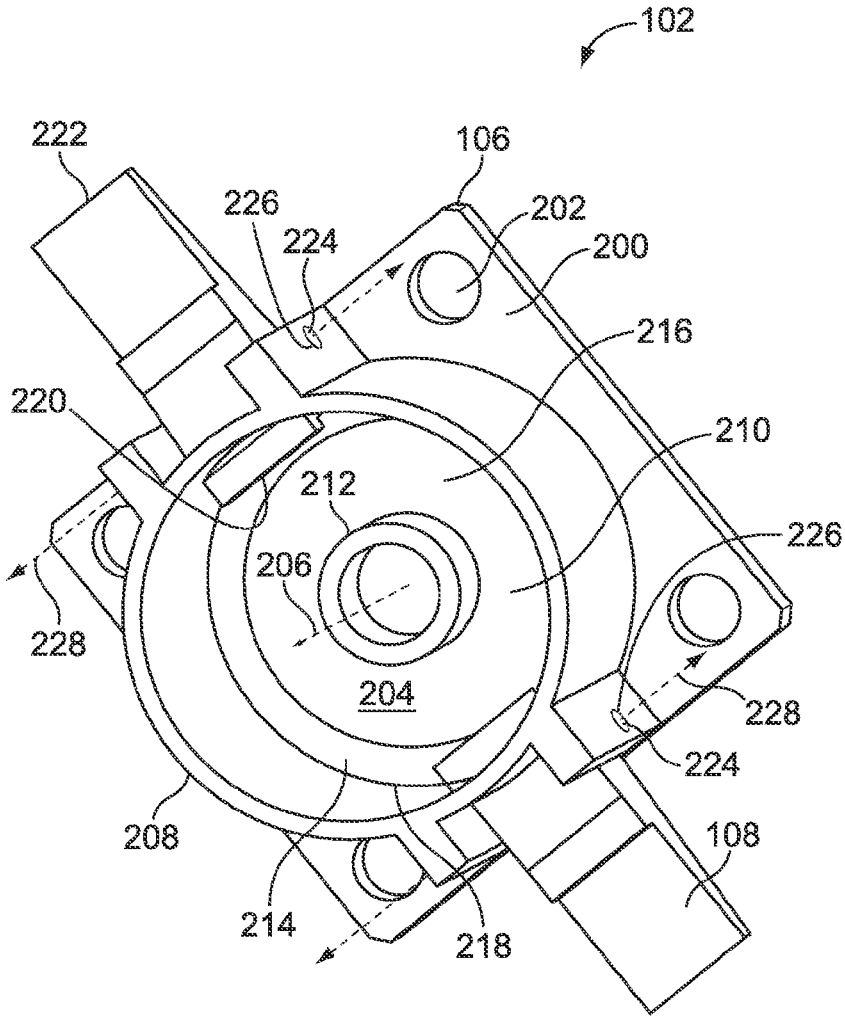
FIG. 2 is a perspective view of a receptacle connector shown in FIG. 1 in accordance with one embodiment of the present disclosure.

FIG. 2 is a perspective view of the receptacle connector 102 in accordance with one embodiment of the present disclosure. The housing 106 of the receptacle connector 102 may include a dielectric material. For example, the housing 106 may be formed from one or more polymers. The housing 106 shown in FIG. 2 includes a mounting flange 200. The mounting flange 200 is a planar body or section of the housing 106 that may be affixed to a panel of a device, such as a computing device. For example, the mounting flange 200 includes openings 202 that may receive fasteners (not shown) for securing the mounting flange 200 to a panel. Alternatively, the housing 106 may not include the mounting flange 200.

The housing 106 defines an interior chamber 204 that extends along a longitudinal axis 206 from a mating face 208 of the housing 106 to a dielectric body 210. In the illustrated embodiment, the interior chamber 204 extends to an internal surface 216 of the dielectric body 210. The internal surface 216 may be an exposed front surface of the dielectric body 210 that is located within the interior chamber 204. The dielectric body 210 may include, or be formed from, a dielectric material, such as one or more polymers. The housing 106 may have a cylindrical shape such that the mating face 208 is an approximately circular ring. Alternatively, the housing 106 and/or the mating face 208 may have a different shape, such as a polygon. The mating connector 104 (shown in FIG. 1) is received into the interior chamber 204 along the longitudinal axis 206 through the mating face 208.

A center contact 212 is disposed within the interior chamber 204. The center contact 212 is a conductive body that is oriented along the longitudinal axis 206 of the housing 106. Alternatively, the center contact 212 may not be oriented along the longitudinal axis 206. For example, the center contact 212 may be offset from the longitudinal axis 206. The center contact 212 extends through the dielectric body 210. The center contact 212 may be disposed through the middle or axial center of the dielectric body 210.

In the illustrated embodiment, an outer contact 218 is located in the interior chamber 204. The outer contact 218 may encircle the dielectric body 210 and the center contact 212 along the longitudinal axis 206. As shown in FIG. 2, a mating face 214 of the outer contact 218 is exposed at the internal surface 216 of the dielectric body 210. For example, a portion of the outer contact 218 referred to as the mating face 214 may protrude from or be exposed at the internal surface 216. The dielectric body 210 separates the center contact 212 from the outer contact 218 along the longitudinal axis 206 and through the portion of the housing 106 that includes the dielectric body 210. In an embodiment where the receptacle connector 102 is a coaxial connector, the center contact 212 may communicate data signals using the center contact 212 while the outer contact 218 is electrically joined with a ground reference to shield the center contact 212 from electromagnetic interference.

Figure 3:
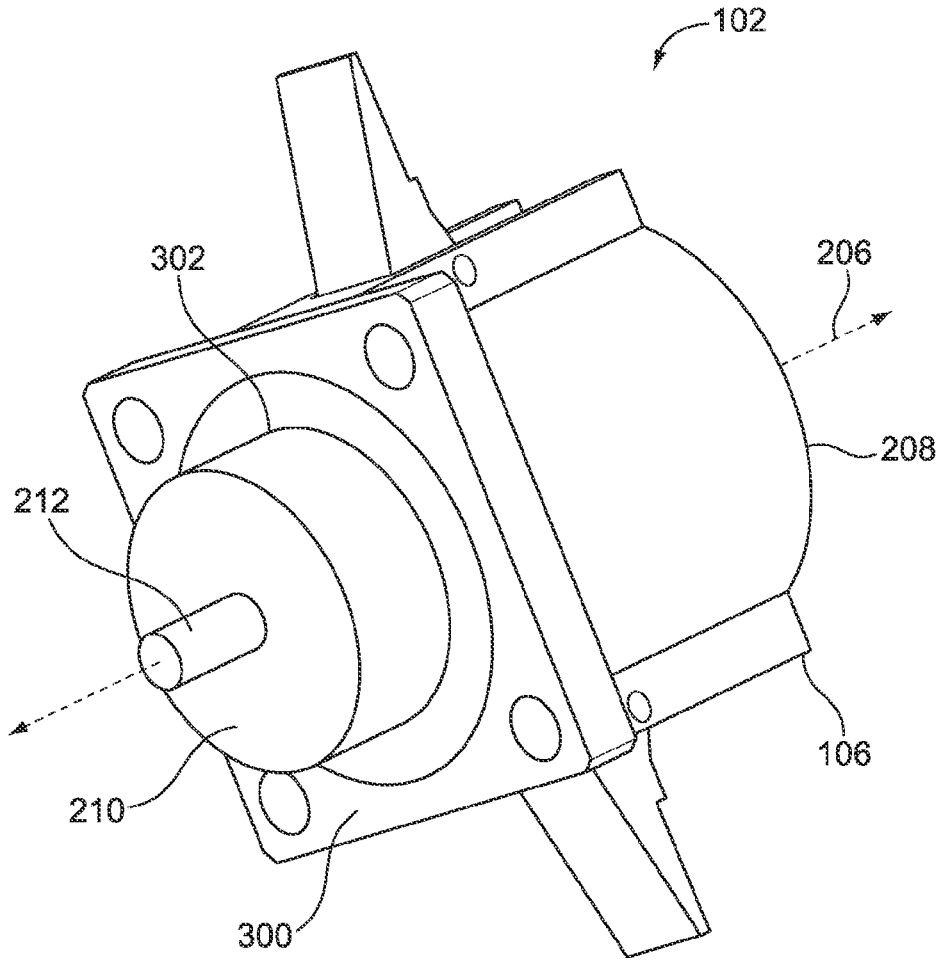
FIG. 3 is another perspective view of the receptacle connector shown in FIG. 1 in accordance with one embodiment of the present disclosure.

FIG. 3 is another perspective view of the receptacle connector 102 in accordance with one embodiment of the present disclosure. FIG. 3 shows the rear view of the receptacle connector 102. The housing 106 of the receptacle connector 102 extends along the longitudinal axis 206 from the mating face 208 to a mounting surface 300. The mounting surface 300 may engage a panel or other surface to which the receptacle connector 102 is mounted. In the illustrated embodiment, the dielectric body 210 protrudes from the mounting surface 300 and the center contact 212 protrudes from the dielectric body 210. The center contact 212 may be joined with a wire, cable, or other component to electrically couple the center contact 212 with the wire, cable, or other component.

A conductive gasket 302 extends around the dielectric body 210 at the mounting surface 300. The conductive gasket 302 may be electrically joined with the outer contact 218 (shown in FIG. 2). The conductive gasket 302 may engage a conductive portion of a panel or a conductive panel to which the receptacle connector 102 is mounted in order to electrically couple the outer contact 218 with the panel. Alternatively, the conductive gasket 302 may engage another conductive member, such as a wire or terminal, that electrically joins the outer contact 218 with a ground reference. In another embodiment, the outer contact 218 may extend through or be exposed at the mounting surface 300 such that the outer contact 218 may be electrically joined with a ground reference without use of the conductive gasket 302.

Returning to the discussion of the receptacle connector 102 as shown in FIG. 2, the two lever arms 108 are joined to opposite sides of the housing 106. While two lever arms 108 are shown, alternatively a different number may be used. Also, while the lever arms 108 are shown on opposite sides of the housing 106, alternatively the lever arms 108 may be placed closer together. Each lever arm 108 extends between an engagement end 220 and an actuation end 222. The engagement end 220 is located within the interior chamber 204 of the housing 106 while the actuation end 222 is located outside of the housing 106. For example, the housing 106 may include openings 500 (shown in FIG. 5) through which the lever arms 108 extend.

Pivot pins 224 extend through the lever arms 108. The pivot pins 224 are received in openings 226 in the housing 106 to pivotally couple the lever arms 108 to the housing 106. The pivot pins 224 define pivot axes 228 about which the lever arms 108 pivot relative to the housing 106. As described below, the engagement end 220 engages the mating connector 104 (shown in FIG. 1) when the mating connector 104 is loaded into the interior chamber 204. The actuation end 222 is moved by an operator toward the housing 106 by pivoting the lever arm 108 about the pivot axis 228. As the lever arm 108 pivots toward the housing 106, the engagement end 220 drives the mating connector 104 toward the center contact 212 along the longitudinal axis 206 within the interior chamber 204.

Figure 4:
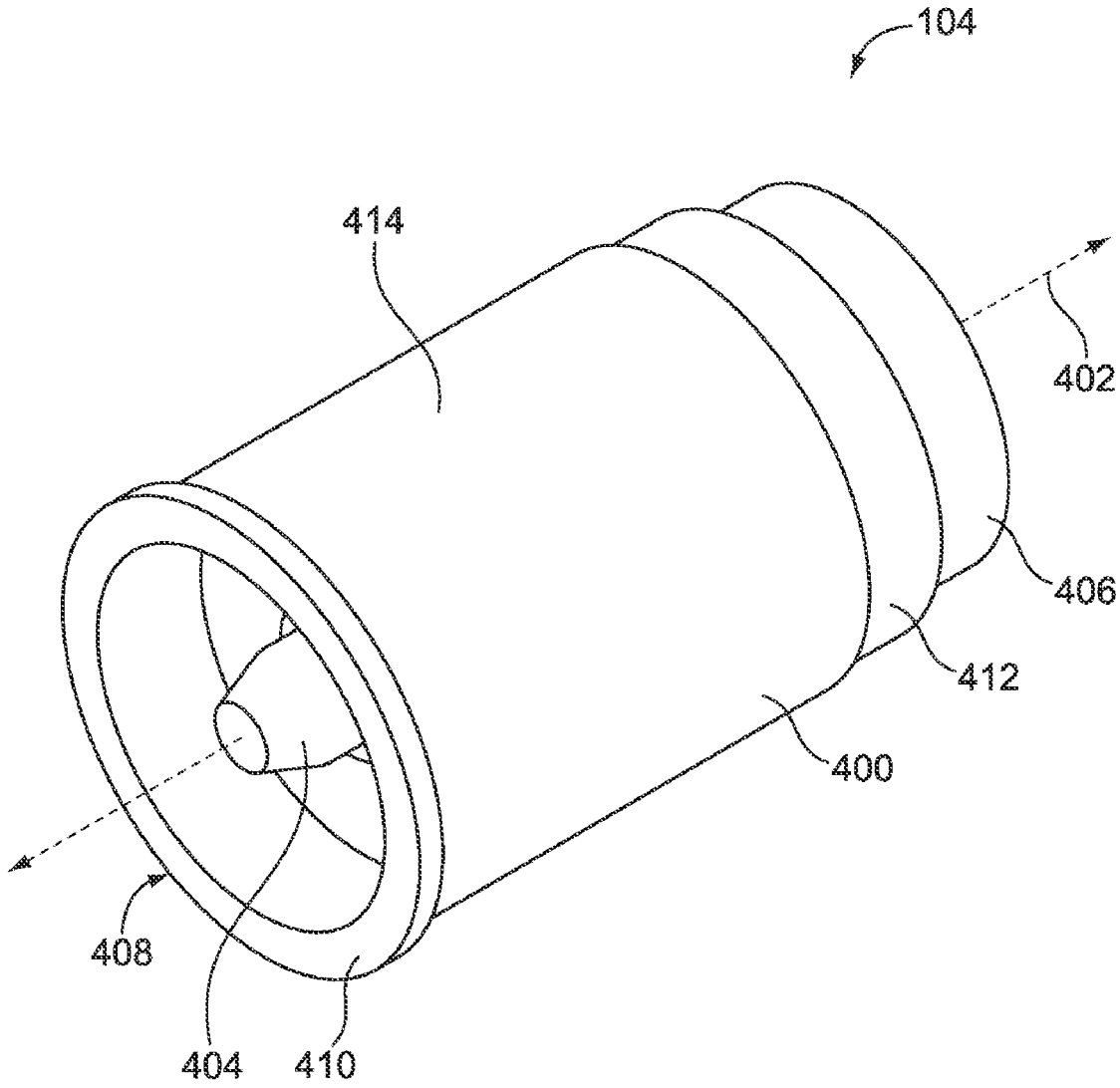
FIG. 4 is a perspective view of a mating connector shown in FIG. 1 in accordance with one embodiment of the present disclosure.

FIG. 4 is a perspective view of the mating connector 104 in accordance with one embodiment of the present disclosure. The mating connector 104 shown in FIG. 4 has a plug body 400 that is elongated along a center axis 402. The plug body 400 may be a component that is joined to a cable or other component, or may constitute a portion of a cable. For example, the plug body 400 may represent the end or section of a coaxial cable that mates with the receptacle connector 102. The plug body 400 extends along the center axis 402 from a front face 408. The front face 408 is loaded into the interior chamber 204 (shown in FIG. 2) of the receptacle connector 102 (shown in FIG. 1) to mate the mating connector 104 with the receptacle connector 102.

The plug body 400 includes an axial conductive member 404 oriented along the center axis 402. Alternatively, the axial conductive member 404 may not be oriented along the center axis 402. For example, the axial conductive member 404 may be offset from the center axis 402 while still being held in the plug body 400. A dielectric body 406 encloses the axial conductive member 404 along a portion of the length of the axial conductive member 404. The dielectric body 406 includes, or is formed from, a dielectric material such as one or more polymers. A conductive jacket 412 extends around the dielectric body 406 along all or a portion of the length of the dielectric body 406. The conductive jacket 412 is a conductive body of the plug body 400 that is a conductive shield. Similar to the center and outer contacts 212, 218 (shown in FIG. 2) described above, the axial conductive member 404 may communicate data signals while the conductive jacket 412 is joined with a ground reference to shield the axial conductive member 404 from electromagnetic interference. The dielectric body 406 separates the axial conductive member 404 from the conductive jacket 412 along the plug body 400.

The conductive jacket 412 may terminate at a conductive ring 410 disposed at the front face 408 of the plug body 400. The conductive ring 410 may be a portion of the conductive jacket 412 that is partially bent or folded back to form the conductive ring 410. Alternatively, the conductive ring 410 may be separately formed from the conductive jacket 412 and coupled to the conductive jacket 412. The conductive ring 410 may form a flange at the front face 408 by radially projecting from the plug body 400 around the front face 408.

An insulative sheath 414 extends around the conductive jacket 412 along a portion of the length of the plug body 400. The insulative sheath 414 includes, or is formed from, a dielectric material such as one or more polymers. The insulative sheath 414 protects the conductive jacket 412 from contact with other conductive components. As shown in FIG. 4, the insulative sheath 414 extends to, but does not cover, the conductive ring 410.

Figure 5:
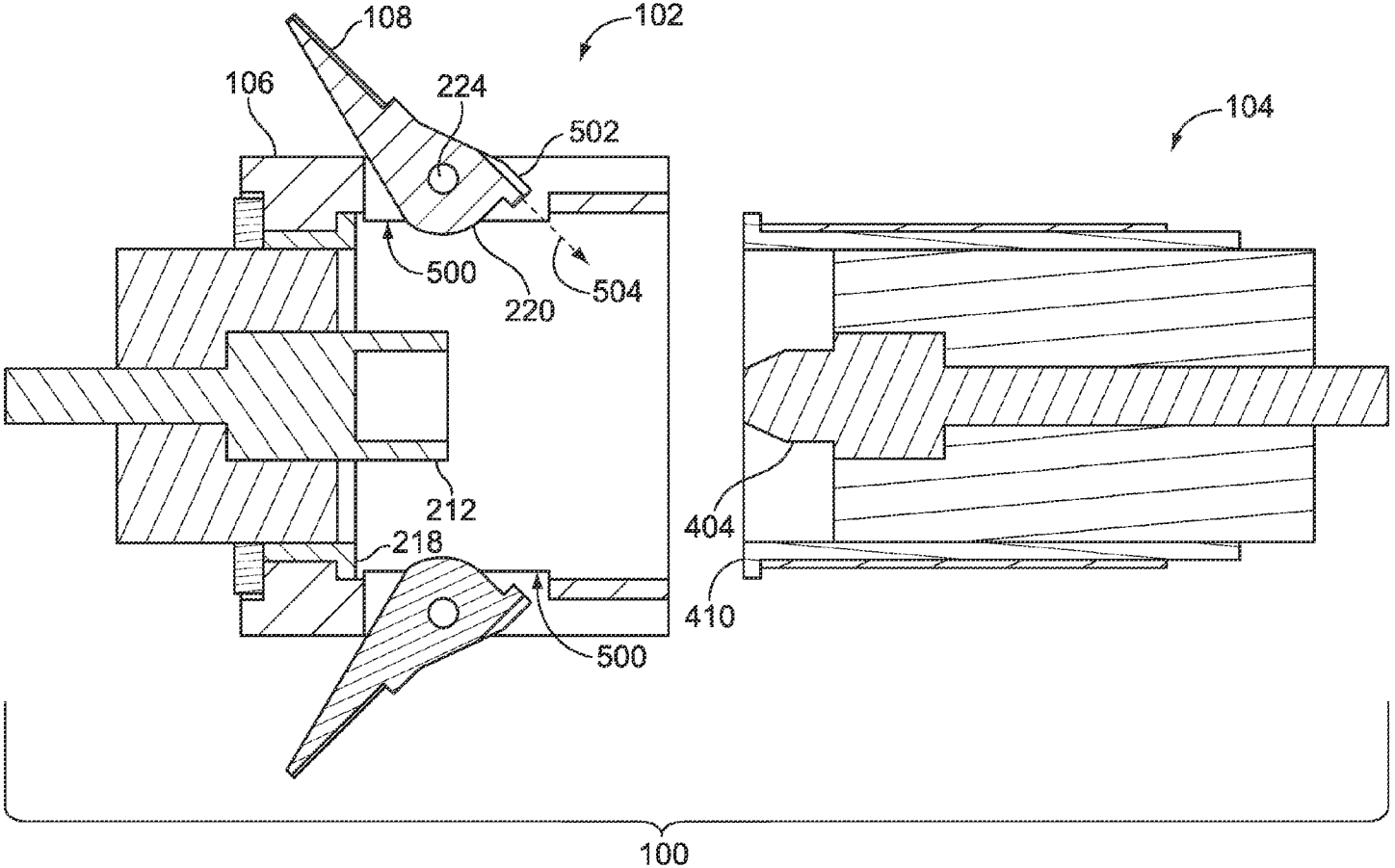
FIG. 5 is a cross-sectional view of the connector assembly along line A-A shown in FIG. 1 in an unmated relationship in accordance with one embodiment of the present disclosure.

FIG. 5 is a cross-sectional view of the connector assembly 100 along line A-A shown in FIG. 1 in an unmated relationship in accordance with one embodiment of the present disclosure. In an unmated relationship, the mating connector 104 is outside of the receptacle connector 102. As shown in FIG. 5, the axial conductive member 404 of the mating connector 104 has not engaged the center contact 212 of the receptacle connector 102 and the conductive ring 410 of the mating connector 104 has not engaged the outer contact 218 of the receptacle connector 102. Also as shown in FIG. 5, the lever arms 108 extend through the openings 500 in the housing of the receptacle connector 102. In an unmated relationship, the lever arms 108 do not engage the mating connector 104.

In the illustrated embodiment, the lever arms 108 include projections 502 that extend from the engagement ends 220 of the lever arms 108. The projections 502 may protrude from the engagement ends 220 along extension directions 504. The extension directions 504 may be offset from the pivot pins 224 or pivot axes 228 (shown in FIG. 2) of the lever arms 108. For example, the extension directions 504 may not extend through or across the pivot pins 224 or pivot axes 228 and may be spaced apart from the pivot pins 224 and pivot axes 228. As described below, offsetting the projections 502 from the pivot pins 224 and pivot axes 228 may enable the lever arms 108 to drive the mating connector 104 into an abutted relationship with the outer contact 218 and lock the lever arms 108 into a secure position that prevents the mating connector 104 from releasing from the abutted relationship with the outer contact 218.

Figure 6:
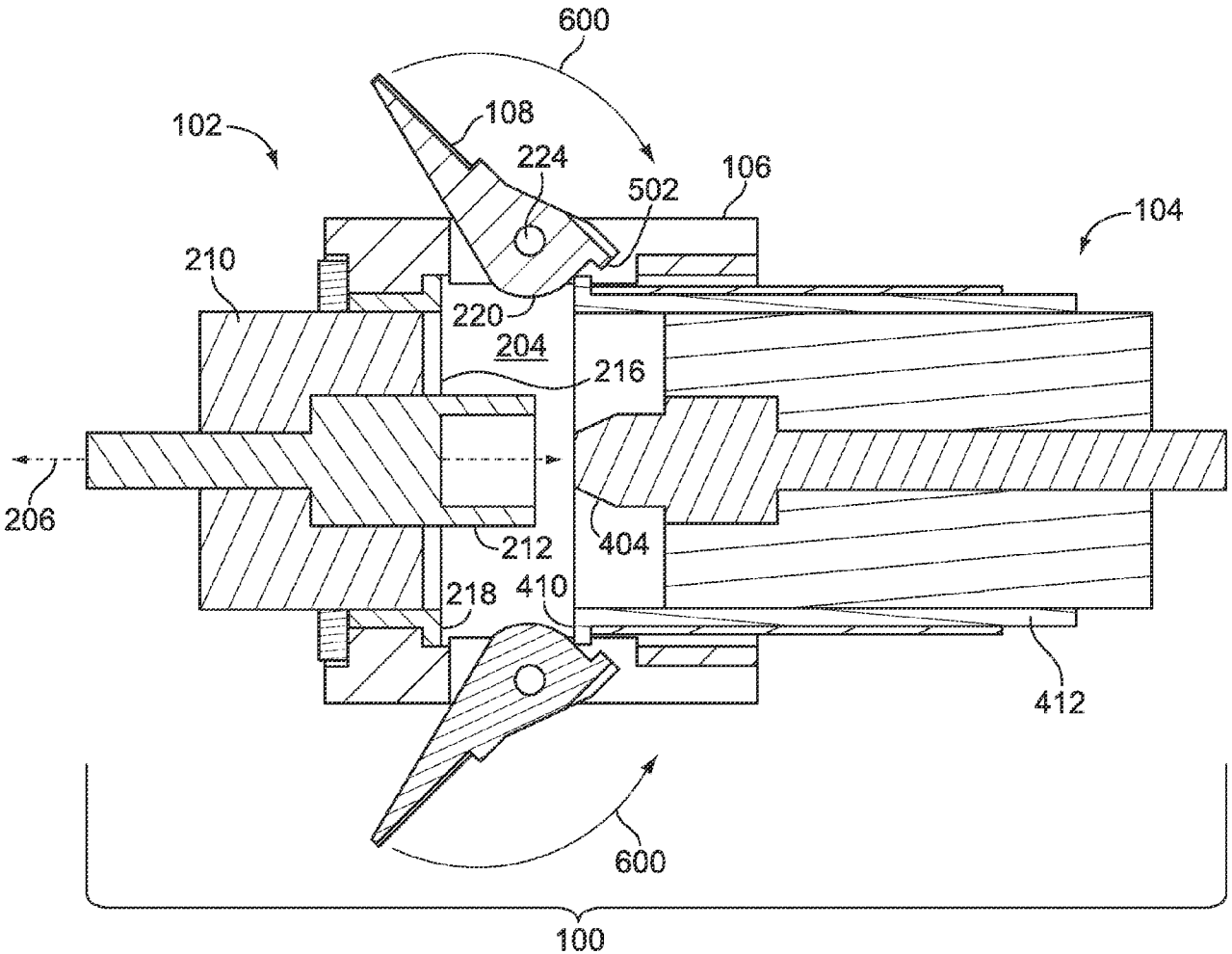
FIG. 6 is a cross-sectional view of the connector assembly along line A-A shown in FIG. 1 when the mating connector is loaded into the receptacle connector in accordance with one embodiment of the present disclosure.

FIG. 6 is a cross-sectional view of the connector assembly 100 along line A-A shown in FIG. 1 when the mating connector 104 is loaded into the receptacle connector 102 in accordance with one embodiment of the present disclosure. In order to mate the mating connector 104 with the receptacle connector 102, the mating connector 104 is loaded into the interior chamber 204 of the receptacle connector 102 along the longitudinal axis 206 of the receptacle connector 102. The mating connector 104 is loaded sufficiently far such that the conductive ring 410 of the conductive jacket 412 is located at or near the engagement ends 220 of the lever arms 108. For example, the mating connector 104 may be loaded into the interior chamber 204 until the conductive ring 410 passes the projections 502 of the lever arms 108 and the conductive ring 410 is located between the projections 502 and the outer contact 218 of the receptacle connector 102.

As shown in FIG. 6, the conductive ring 410 may form a flange that radially projects from the mating connector 104. In this position, the lever arms 108 may be manually actuated toward the housing 106 along engagement directions 600 by an operator. Moving the lever arms 108 along the engagement directions 600 causes the lever arms 108 to pivot about the pivot axes 228 (shown in FIG. 2) and pivot pins 224. As the lever arms 108 pivot, the projections 502 engage the conductive ring 410. For example, the projections 502 may contact the portions of the conductive ring 410 that radially project from the mating connector 104. The lever arms 108 continue to pivot in the engagement directions 600 and toward the housing 106 to push or drive the mating connector 104 along the longitudinal axis 206. The mating connector 104 is driven toward the internal surface 216 of the dielectric body 210 of the receptacle connector 102, with the axial conductive member 404 being driven toward the center contact 212 of the receptacle connector 102 and the conductive ring 410 being driven toward the outer contact 218 of the receptacle connector 102.

Figure 7:
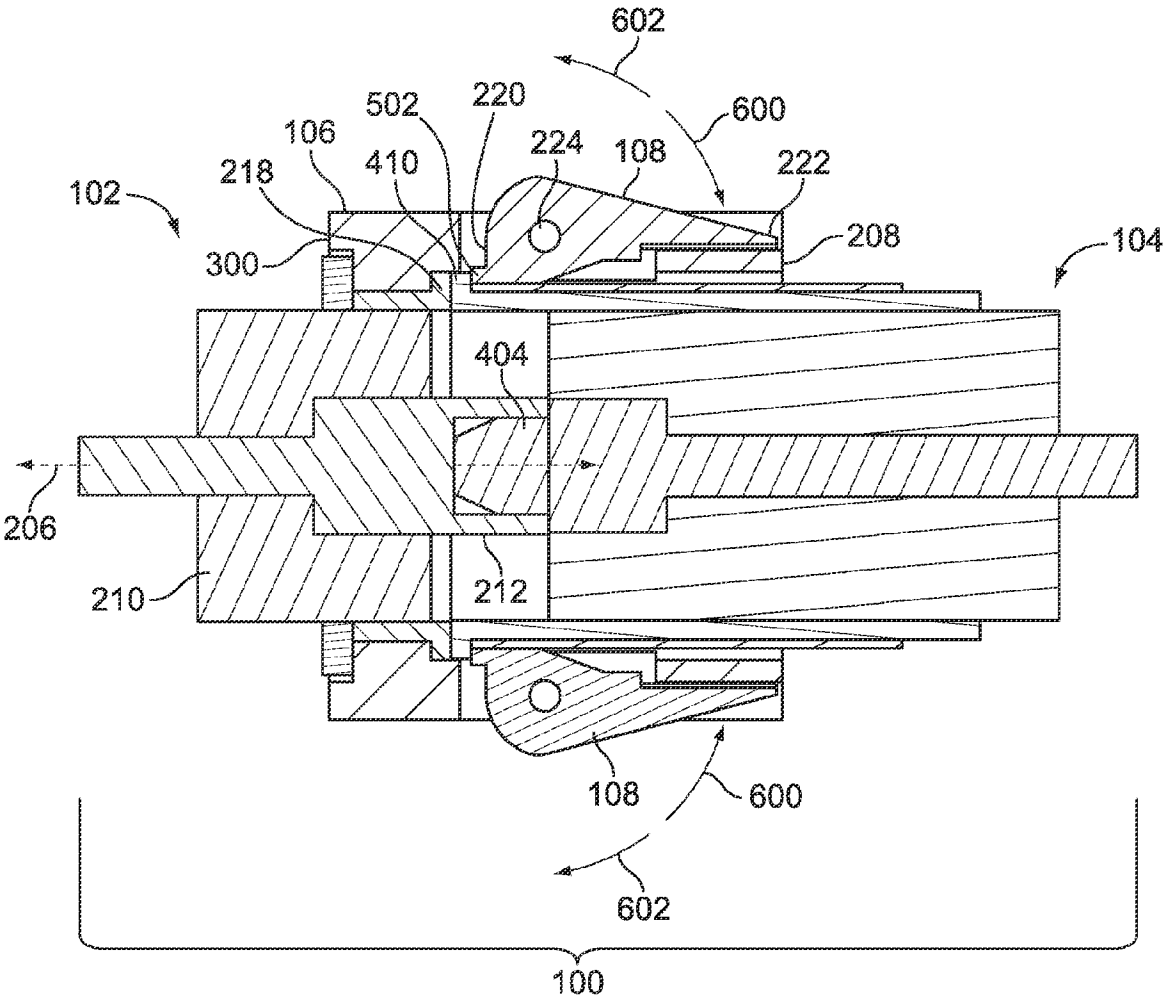
FIG. 7 is a cross-sectional view of the connector assembly along line A-A shown in FIG. 1 in a mated relationship in accordance with one embodiment of the present disclosure.

FIG. 7 is a cross-sectional view of the connector assembly 100 along line A-A shown in FIG. 1 in a mated relationship in accordance with one embodiment of the present disclosure. The lever arms 108 are actuated along the engagement directions 600 until the mating connector 104 mates with the receptacle connector 102. For example, the lever arms 108 may continue to pivot about the pivot pins 224 while the projections 502 engage and drive the mating connector 104 toward the center contact 212 of the receptacle connector 102. The projections 502 engage the conductive ring 410 and drive the conductive ring 410 toward the outer contact 218. For example, as the lever arms 108 pivot about the pivot pins 224, the actuation ends 222 move toward the mating face 208 of the housing 106 while the engagement ends 220 and the projections 502 rearwardly move toward the mounting surface 300 of the housing 106.

The rearward movement of the engagement ends 220 and projections 502 drive the mating connector 104 along the longitudinal axis 206 toward the dielectric body 210 of the receptacle connector 102. In one embodiment, the lever arms 108 continue to pivot at least until the axial conductive member 404 of the mating connector 104 engages the center contact 212 of the receptacle connector 102 and the conductive ring 410 of the mating connector 104 engages the outer contact 218 of the receptacle connector 102. Once the axial conductive member 404 engages the center contact 212, the mating connector 104 and receptacle connector 102 can communicate data signals therebetween using the axial conductive member 404 and the center contact 212. The conductive ring 410 may engage the outer contact 218 by abutting the outer contact 218 to electrically couple the conductive ring 410 with the outer contact 218. The conductive ring 410 may then be coupled with a ground reference via the outer contact 218 or the outer contact 218 may be coupled with the ground reference via the conductive ring 410.

In the illustrated embodiment, the lever arms 108 lock into position when the mating connector 104 and receptacle connector 102 mate with one another as shown in FIG. 7. The lever arms 108 may snap or be placed into the position shown in FIG. 7 and impart a compressive force on the conductive ring 410. For example, the lever arms 108 may pivot to the position shown in FIG. 7 and compress the conductive ring 410 between the projections 502 and the outer contact 218. The location of the projections 502 enables the lever arms 108 to impart a force on the conductive ring 410 while the lever arms 108 are in the engaged positions shown in FIG. 7. This compressive force may ensure that the conductive ring 410 and outer contact 218 remain electrically coupled with one another. For example, the compressive force may secure the conductive ring 410 abutted against the outer contact 218 around the entire circumference or 360 degrees of the conductive ring 410 and outer contact 218. The lever arms 108 may remain in the position shown in FIG. 7 to ensure that the axial conductive member 404 and the center contact 212 remain electrically coupled.

In order to decouple the mating connector 104 and receptacle connector 102, the lever arms 108 may be pivoted in decoupling directions 602. The decoupling directions 602 are oriented opposite of the engagement directions 600 such that the actuation ends 222 of the lever arms 108 are moved away from the mating face 208 of the housing 106 and toward the mounting surface 300 of the housing 106. As the lever arms 108 move in the decoupling directions 602, the compressive force is no longer applied to the conductive ring 410 and the mating connector 104 is no longer driven toward the center contact 212. As a result, the axial conductive member 404 may decouple from the center contact 212 and the conductive ring 410 may no longer abut the outer contact 218, thereby decoupling the mating connector 104 from the receptacle connector 102.

While the embodiment shown in the attached Figures shows and describes the conductive ring 410 providing a radial flange that is engaged and driven by the pivoting lever arms 108, alternatively the lever arms 108 may engage a different component or portion of the mating connector 104. For example, the mating connector 104 may include a different feature or component that radially projects from the mating connector 104 and is engaged and driven by the lever arms 108. In another example, the mating connector 104 may include recesses or notches into which the engagement ends 220 of the lever arms 108 are received. For example, the projections 502 may be received in notches in the mating connector 104 in order to engage and drive the mating connector 104 along the longitudinal axis 206 of the receptacle connector 102.

Additionally, while the receptacle connector 102 is shown as being capable of being mounted to a panel, alternatively the mating connector 104 may be mounted to a panel. For example, the mating connector 104 may include a mounting flange similar to the mounting flange 200 (shown in FIG. 2) to enable the mating connector 104 to be mounted to a panel.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a receptacle connector including a housing defining an interior chamber, a lever arm pivotally joined to the housing, and a center contact disposed within the interior chamber and oriented along a longitudinal axis of the receptacle connector; and a mating connector including a plug body and an axial conductive member disposed in the plug body along a center axis of the plug body, wherein the lever arm of the receptacle connector includes a projection that extends from the lever arm along a first direction and engages the plug body of the mating connector when the plug body is received in the interior chamber, the lever arm configured to pivot about an axis extending in a second direction relative to the housing to cause the projection to engage and drive the plug body within the interior chamber and mate the axial conductive member with the center contact, further wherein the first direction and the second direction are oriented along non-intersecting lines.

2. The connector assembly of claim 1, wherein the plug body of the mating connector includes a flange that is engaged by the lever arm of the receptacle connector to drive the plug body along the longitudinal axis and into the interior chamber of the receptacle connector.

3. The connector assembly of claim 1, wherein at least one of the receptacle connector or the mating connector is mounted to a panel.

4. The connector assembly of claim 1, wherein the lever arm pivots toward the housing when actuated to drive the plug body toward the center contact, the lever arm locking in position when the axial conductive member of the mating connector engages the center contact.

5. The connector assembly of claim 1, wherein the plug body of the mating connector includes an outwardly projecting flange and the projection of the lever arm of the receptacle connector is configured to engage the flange outside of the plug body and drive the plug body into the interior chamber of the receptacle connector when the lever arm pivots toward the housing of the receptacle connector.

6. The connector assembly of claim 1, wherein the receptacle connector comprises an outer contact disposed in the interior chamber and extending around the longitudinal axis and the mating connector comprises a conductive ring disposed at a front face of the plug body and extending around the center axis, the outer contact mating with the conductive ring when the mating connector is received in the receptacle connector.

7. The connector assembly of claim 6, wherein the lever arm is configured to pivot relative to the housing to drive the outer contact into an abutted relationship with the conductive ring.

8. The connector assembly of claim 1, wherein the lever arm extends between an engagement end and an actuation end, the engagement end disposed within the housing and configured to engage the mating connector, the actuation end disposed outside of the housing and configured to be moved to pivot the lever arm relative to the housing.

9. The connector assembly of claim 8, wherein the lever arm pivots about an axis located between the engagement end and the actuation end.

10. A coaxial receptacle connector comprising:

a housing defining an interior chamber that extends along a longitudinal axis;

a center contact disposed in the interior chamber and oriented along the longitudinal axis; and a lever arm pivotally joined to the housing, the lever arm extending between an engagement end disposed within the housing and an actuation end disposed outside the housing, the engagement end including a projection that extends from the lever arm along a first direction and contacts a mating connector that is loaded into the interior chamber, the actuation end moveable to pivot the lever arm about an axis extending in a second direction, the lever arm pivoting to engage the projection with the mating connector and drive the mating connector toward the center contact along the longitudinal axis, wherein the first direction and the second direction are oriented along non-intersecting lines.

11. The coaxial receptacle connector of claim 10, wherein the lever arm pivots about an axis between the actuation end and the engagement end.

12. The coaxial receptacle connector of claim 10, wherein the housing is configured to be mounted to a panel.

13. The coaxial receptacle connector of claim 10, wherein the lever arm pivots toward the housing when actuated to drive the plug body toward the center contact, the lever arm locking in position when the axial conductive member of the mating connector engages the center contact.

14. The coaxial receptacle connector of claim 10, wherein the projection of the lever arm is configured to engage an outwardly protruding flange of the mating connector outside of the mating connector to drive the mating connector into the interior chamber of the housing when the lever arm pivots toward the housing.

15. The coaxial receptacle connector of claim 10, wherein the interior chamber of the housing extends along the longitudinal axis from a mating face to an internal surface, further comprising an outer contact disposed at the internal surface, the pivot arm actuated to drive the mating connector along the longitudinal axis such that a conductive jacket of the mating connector abuts the outer contact at the internal surface.

16. The coaxial receptacle connector of claim 15, further comprising an outer contact encircling the longitudinal axis in the interior chamber at the internal surface, the outer contact configured to mate with a conductive ring of the mating connector.

17. A receptacle connector comprising:

a housing that defines an interior chamber extending along a longitudinal axis, the interior chamber configured to receive a mating connector that includes an axial conductive member and a conductive ring extending around the axial conductive member;

a center contact disposed within the interior chamber;

an outer contact extending around the center contact within the interior chamber; and a lever arm pivotally joined to the housing and including a projection that extends from the lever arm along a first direction, the lever arm pivotable about an axis extending in a second direction with respect to the housing to cause the projection to engage and drive the mating connector along the longitudinal axis in the interior chamber when the mating connector is loaded into the interior chamber, the lever arm driving the mating connector toward the outer contact until the outer contact is electrically coupled with the conductive ring of the mating connector and the center contact is electrically joined with the axial conductive member of the mating connector, wherein the first direction and the second direction are oriented along non-intersecting lines.

18. The receptacle connector of claim 17, wherein the outer contact is configured to be electrically connected with a ground reference such that the conductive ring of the mating connector is coupled with the ground reference when the lever arm drives the conductive ring into an abutted relationship with the outer contact.

19. The coaxial receptacle connector of claim 17, wherein the lever arm pivots toward the housing when actuated to drive the plug body toward the center contact, the lever arm locking in position when the axial conductive member of the mating connector engages the center contact.

20. The receptacle connector of claim 17, wherein the projection of the lever arm is configured to engage an outwardly protruding flange of the mating connector outside of the mating connector and drive the mating connector into the interior chamber of the housing when the lever arm pivots toward the housing.

21. The connector assembly of claim 17, wherein the lever arm extends between an engagement end and an actuation end, the engagement end disposed within the housing and configured to engage the mating connector, the actuation end disposed outside of the housing and configured to be moved to pivot the lever arm relative to the housing.

22. The connector assembly of claim 21, wherein the lever arm pivots about an axis located between the engagement end and the actuation end.

* * * * *